US005240632A

United States Patent [19]

Brumbaugh

[11] Patent Number: 5,240,632

[45] Date of Patent: Aug. 31, 1993

[54] MACHINE DISHWASHER WATER SPOT CONTROL COMPOSITION

[75] Inventor: Ernest H. Brumbaugh, Rockford, Mich.

[73] Assignee: Amway Corporation, Ada, Mich.

[21] Appl. No.: 932,641

[22] Filed: Aug. 19, 1992

Related U.S. Application Data

[63] Continuation of Ser. No. 377,467, Jul. 10, 1989, abandoned, which is a continuation of Ser. No. 144,658, Jan. 12, 1988, abandoned, which is a continuation of Ser. No. 844,404, Mar. 26, 1986, abandoned.

[51] Int. Cl.[5] ..... C11D 3/06; C11D 3/37; C11D 3/386; C11D 3/39

[52] U.S. Cl. ..... 252/95; 252/99; 252/102; 252/135; 252/174.12; 252/174.24; 252/DIG. 12

[58] Field of Search ..... 252/95, 99, 102, 135, 252/174.12, 174.24, DIG. 12

[56] References Cited

U.S. PATENT DOCUMENTS

| | | | |
|---|---|---|---|
| 3,579,455 | 5/1971 | Sabatelli | 252/135 |
| 3,627,686 | 12/1971 | Sabatelli | 252/527 |
| 4,203,858 | 5/1980 | Chakrabarti | 252/135 |
| 4,309,299 | 1/1982 | Rapisarda et al. | 252/95 |
| 4,568,476 | 2/1986 | Kielman et al. | 252/95 |
| 4,597,886 | 7/1986 | Goebhart et al. | 252/95 |

*Primary Examiner*—Paul Lieberman
*Assistant Examiner*—Erin M. Higgins
*Attorney, Agent, or Firm*—Price, Heneveld, Cooper, DeWitt & Litton

[57] ABSTRACT

Water spot reduction compositions containing an oxygen bleach, a proteolytic enzyme, and a polyacrylate for use in cleaning dishes and the like in a machine dishwasher. The compositions effectively reduce the presence of water spots which form on dish surfaces and the like during machine dishwashing operations.

15 Claims, No Drawings

MACHINE DISHWASHER WATER SPOT CONTROL COMPOSITION

This is a continuation of application Ser. No. 07/377,467, filed Jul. 10, 1989, now abandoned, which in turn is a continuation of application Ser. No. 07/144,658, filed Jan. 12, 1988, now abandoned, which itself is a continuation of application Ser. No. 06/844,404, filed Mar. 26, 1986, now abandoned, of Ernest H. Brumbaugh for MACHINE DISHWASHER WATER SPOT CONTROL COMPOSITION, also abandoned.

FIELD OF THE INVENTION

The present invention relates generally to compositions for use in machine dishwashers to facilitate the cleaning of dishes and the like. More particularly, the present invention relates to compositions which reduce water spot formation on articles cleaned in machine dishwashers.

BACKGROUND OF THE INVENTION

Machine dishwashers are widely used to clean soiled dishes, cooking utensils and other containers for serving and preparing food, such as plates, cups, glasses, silverware, pots, pans, etc., generically referred to as "dishes". While the construction and composition of these items vary widely, most usually have glossy, solid surfaces on which the presence of dried water spots is readily noticeable. These dried water spots are aesthetically unappealing and thus methods and compositions for reducing their number and size are of great concern to the detergent industry as well as to the consumer.

Typical machine dishwashers operate by subjecting food soiled dishes and the like to alternating wash and rinse cycles inside a closed washing chamber. Spray nozzles inside the chamber direct powerful streams of hot wash liquor and rinse water onto the soiled dish surfaces. A considerable amount of food residue is thereby removed by the force exerted by these pressurized water streams. There is, however, a substantial amount of food residue which resists dislodgement by the water jets. It is known that by adding certain detergent compositions to the wash water, a much greater quantity of food soil can be removed from soiled article surfaces during the washing cycle. These machine or "automatic" dishwasher detergent compositions as they are known dramatically increase the cleaning efficiency of machine dishwashers primarily by alkaline cleaning action and through the emulsification and dispersion of food residue which otherwise clings to dish surfaces despite the action of wash water jets.

While food soils vary greatly in composition, generally food residue which remains on dish surfaces contains an organic component which often includes a mixture of various proteins. Since the make-up of typical food residue is known, detergent compositions are formulated such that their various components are effective in breaking down food soils during the wash cycle of automatic dishwashers. The emulsification of food soil is most often achieved through the use of surface active agents or "surfactants", as they are known. Surfactants not only help remove food residue by emulsification, they also provide cleaning power through wetting, foaming, dispersing and penetrating actions. It will be recognized by those skilled in the art that there are many different types of surfactants suitable for use in automatic dishwasher detergents and that low foaming, non-ionic surfactants are especially suited for use in these compositions. For example, low foaming, fatty alcohol ethoxylates and ethylene oxide/propylene oxide block polymers are widely used in the manufacture of machine dishwashing detergents.

Automatic dishwashing detergents also contain detergent builders such as complex phosphates, carbonates, sulfates and silicates which compliment the detersive action of sufactants. For example, by sequestering certain metallic ions which are present in most water sources, phosphates reduce hard water film formation caused by the deposition of metallic precipitates. Moreover, alkalinity builders provide alkaline cleaning power which is particularly important in automatic dishwashing compositions since, by its very nature, automatic dishwashing does not provide the mechanical action of hand dishwashing. Since physical contact with the wash liquor by the consumer does not occur when dishes are cleaned in a machine dishwasher, alkalinity builders are especially suitable for use in automatic dishwashing detergents.

Bleaches can be used in connection with these other dishwashing detergent composition components to remove food residue by breaking down the food residue to simpler components. However, the cleaning action of bleaches differs somewhat from most other dishwashing composition components in that bleaches clean by breaking chemical bonds within molecules rather than the physical bonds which exist between molecules. Although some bleaches are reducing agents, typical bleaches employed in dishwashing compositions are oxidizing agents. Basically, oxidizing bleaches cause the oxidation of chemical bonds, thereby reducing large molecules to smaller units. The smaller units can then be more easily removed during the dishwashing process. The most widely used oxidizing bleaches, particularly in dishwashing compositions, are dry chlorine bleaches. Many compositions use such hypochlorite generators as sodium dichloroisocyanurate and chlorinated trisodium phosphate. Chlorine bleaches are strong oxidizing agents but their usefulness is limited by their tendency to cause unwanted oxidation of other wash compound components and by their brief shelf life. Chlorine bleaches are such strong oxidizing agents that great care must be taken to ensure that the other components with which they are mixed are not adversely affected during storage and, moreover, during use. Due to these and other drawbacks inherent in the use of chlorine bleaches in dishwashing compositions, many formulators have instead proposed that oxygen bleaches be used as the principal oxidizing agent in dishwashing compositions. Oxygen bleaches not only possess greater potential compatibility with other dishwashing composition components, they exhibit much greater stability during storage. While the most frequent oxygen bleach proposed for use is sodium perborate, the use of many inorganic peroxides, such as sodium percarbonate, potassium monopersulfate, and hydrogen peroxide has also been proposed.

It is evident then that the process by which food residue is removed from dish surfaces is the result of various physical and chemical interactions which take place during the washing and rinsing cycles inside the wash chamber. It is theorized that food particles which remain on dish surfaces after final rinse promote water droplet formation and, ultimately, form troublesome dried water spots. These minute food particles serve to anchor droplets of water which would otherwise sheet off of dish surfaces. In particular it is thought that bits of protein residue have a tendency to adhere to article surfaces such that water droplets accumulate around the particles. It follows that it is these protein-anchored water droplets which dry into unsightly water spots. It will be apparent to those skilled in the art that a droplet of water contains a number of minerals and other substances which, when the water evaporates, leaves a residue corresponding roughly in size and shape to the original water droplet. This dried residue causes light to diffract at the water spot in a manner different from that of the surrounding area, thus making the spot visible. It would according to theory, then, seem highly desirable to eliminate as many of these particulate protein masses as possible in order to reduce water droplet accumulations which are believed to be the source of unwanted water spotting of dishes and the like.

It is known in the art that certain proteolytic enzymes are capable of reducing the amount of particulate protein soil on dish surfaces during machine dishwashing operations. In particular, proteases are effective in the removal of protein food soil by virtue of their ability to catalyze the hydrolysis of protein peptide linkages. Proteins, which are very high molecular weight compounds, are thereby converted into smaller peptide units which are more easily removed from article surfaces during the cleaning process. Automatic dishwashing compositions have thus been formulated in the past which contain proteases such as that disclosed in U.S. Pat. No. 4,101,457 to Place et al, entitled "Enzyme-Containing Automatic Dishwashing Composition". Due to a long-held belief in the industry, however, that proteolytic enzymes are incompatible with bleaches in solution, these prior art attempts to utilize proteolytic enzymes in the breakdown of protein soil have generally not included the addition of a bleaching agent in the final composition. Thus, these known compositions have achieved no net reduction of water spotting. Any benefit produced by the protease is negated by the lack of bleach cleansing power in the composition.

Proteolytic enzymes are themselves proteinaceous molecules. Therefore, it has been generally held that when these enzymes are brought in contact with bleach, the enzymes are oxidized into simpler components, thus losing their ability to catalyze the breakdown of peptide bonds. That is, it has been thought that unless the proteolytic enzymes are protected somehow from oxidation by the bleach, they are unable to perform their catalytic function. This widely held belief has resulted in numerous attempts to isolate bleaches from proteass both during storage of compositions containing both of these ingredients as well as during the wash cycle. For example, the attempts have made to microencapsulate bleach to delay its oxidizing action in the wash liquor until after the proteolytic enzymes have had an opportunity to catalytically break down protein soils.

I have discovered that despite the teachings of the prior art that bleaches and proteolytic enzymes are essentially incompatible, a mixture containing an oxygen bleach, a protease and a polyacrylate provides excellent reduction of water droplet formation on washed articles and thus prevents unwanted water spotting during the automatic dishwashing operation. Rather than producing an antagonistic reaction, I have observed that by combining an oxygen bleach, a protease and a polyacrylate along with standard detergent components, an unexpected synergistic action is produced which yields a high degree of water spot prevention. Also, I have discovered an automatic dishwashing detergent composition which contains both an oxygen bleach and a proteolytic enzyme that produces good water spot reduction when used in machine dishwashers.

SUMMARY OF THE INVENTION

In accordance with the present invention, a water spot reduction composition is provided which contains an oxygen bleach, a proteolytic enzyme, and a polyacrylate which, when used in combination with standard machine dishwashing detergent components such as phosphates, silicates and surfactants, reduces water spotting on washed article surfaces.

It is therefore a primary object of the present invention to provide compositions which, when used in an automatic dishwasher, reduce the formation of water spots on dish surfaces and the like.

DETAILED DESCRIPTION OF THE INVENTION

In accordance with the present invention, a water spot reduction composition is provided for use in a machine dishwasher which, when mixed with conventional automatic dishwasher components such as phosphates, silicates, surfactants and inorganic fillers to formulate an automatic dishwasher detergent composition, reduces the presence of water spots on glassware during the machine dishwashing process. The water spot reduction composition an oxygen bleach, a proteolytic enzyme and a polyacrylate. In the final automatic dishwasher formulation, that is, when the water spot reduction composition is combined with phosphate builders, silicates, surfactants and the like to produce a fully built automatic dishwasher detergent composition, the oxygen bleach component of the present invention comprises from about 0.05% to 5% by weight, preferably from about 0.1% to 2% by weight, and most preferably from about 0.25% to 1.0% by weight of available oxygen in the final built detergent.

By available oxygen, it is meant that the compound which is used as a source of oxygen in the present invention provides a certain amount of oxygen which is available to participate in oxidation reactions. It will be known to those skilled in the art that preferred sources of oxygen disclosed herein are typically sold with reference to their available oxygen content.

It will be known to those skilled in the art, that enzymes and in particular, proteolytic enzymes are sold with reference to their enzyme activity which is stated in various units depending on the individual manufacturer. I prefer to state my preferred concentration ranges of proteolytic enzyme with reference to KNPU/g which is the enzyme activity expression used by Novo Industries of Copenhagen, Denmark. 1 KNPU is the amount of enzyme which hydrolyzes casein at standard reaction conditions at an initial rate such that colorimetric change of reaction with 2,4,6-Trinitrobenzene-1-sulfonic acid corresponds to 1 millimol per glycine per minute. Standard reaction conditions are 0.05 Hammerstein casein, 0.05 molar borate buffer, P.H.9, 50° C. with a reaction time of 20 minutes. In the final automatic dishwasher formulation, that is, when the water spot reduction composition of the present invention is combined with phosphate builders, silicates, surfactants and the like to produce a fully built automatic dishwasher detergent composition, the proteolytic enzyme component of the present invention provides from about 2 to 200 KNPU, preferably from 4 to 80 KNPU and most preferably from 10 to 40 KNPU per kilogram of the final built detergent.

The polyacrylate component of the present invention comprises from about 0.1% to 20% by weight, and preferably from 1% to 10% by weight of the final built detergent composition. In other words, the water spot reduction composition of the present invention is comprised of an oxygen bleach as a source of available oxygen, a proteolytic enzyme which provides enzymatic activity and a polyacrylate. Each of these three components are present in the water spot reduction composition in relative quantities which produce, respectively, available oxygen, enxymatic activity and polyacrylate in the percentage by weight ranges given with respect to the total weight of the final built detergent composition which includes phosphate builders, silicates, surfactants and the water spot reduction composition of the present invention.

Preferred oxygen bleaches for providing a source of available oxygen for use in the present invention include water soluble percompounds such as alkaline metal perborates, percarbonates, persulfates and perphosphates as well as alkaline earth perphosphates, percarbonates and persulfates. Suitable alkali metal perborates include potassium perborate, sodium perborate tetrahydrate, and sodium perborate monohydrate. Most preferred oxygen bleaches for use in the present invention are the sodium perborates and in particular, sodium perborate monohydrate. Other suitable compounds which provide the necessary source of available oxygen for use in this invention are hydrogen peroxide and its inorganic adducts which include the aforementioned alkali metal perborates, persulfates and percarbonates. In general, any organic peracid source of available oxygen is suitable for use in the present invention. Compatible mixtures of these oxygen bleaches may be suitable for use herein. It will also be apparent to those skilled in the art that oxygen bleach activators may be suitable for use in the practice of the present invention.

Suitable proteolytic enzymes for use in the present invention include trypsin, chymotrypsin, pepsin, papain, bromelin, carboxylase, collagenase, keratinase, elastase, amino peptidase, subtilisin, and aspergillopeptidase. The subtilisin enzymes derived from *bacillus subtillis* are especially preferred, such as Esperase 4.0T sold by Novo Industries which has a minimum enzyme activity of 4.0 KNPU/g. Proteolytic enzymes suited for use herein are active in a pH range of from about 4 to about 12 at a temperature of from about 50° F. to about 200° F. Although suitable proteolytic enzymes can be obtained from many commercial sources, trade formulations such as Alcalase, sold by Novo Industries of Copenhagen, Denmark; Maxatase, sold by Koninklijke Gist-Brocades NV of Delft, Holland; Protease AP, sold by Schweizerische Ferment AG of Basel, Switzerland; and, Esperase and Savinase, also sold by Novo Industries, are suitable for use in the present invention.

Suitable polyacrylates for use herein include polymers and copolymers of acrylic acid, methacrylic acid, esters of these acids or acrylonitrile. Preferred polymers of the above group are sodium polyacrylate and sodium polyhydroxyacrylate. It is preferred that the polyacrylates used in the present invention have a molecular weight of from about 500 to about 200,000, and more preferably from about 1,000 to about 10,000. It is permissible for use herein to use a mixture of the various preferred polyacrylates as the polyacrylate component of the present composition.

In another embodiment of the present invention, a machine dishwashing detergent composition is provided which effectively reduces water spot formation over prior art compositions which comprises a phosphate builder, a silicate, a surfactant, an oxygen bleach, a proteolytic enzyme, optionally, a sulfate compound, and optionally, a carbonate compound. In this embodiment, suitable phosphates include the polyphosphates, specific examples of which include sodium tripolyphosphate, potassium tripolyphosphate, tetrasodium monohydrogen tripolyphosphate, and trisodium dihydrogen tripolyphosphate. Expecially preferred for use herein is hydrated sodium tripolyphosphate. Phosphate builder comprises from about 0% to about 80% by weight and preferably from about 20% to about 40% by weight of the final composition.

Suitable silicates for use in practice of the present invention include alkali metal silicates such as sodium and potassium silicates. Sodium silicates which have a $SiO_2$ to $Na_2O$ ratio of from 0.5:1 to 4:1 are preferred for use herein. Silicates comprise from about 5% to about 40% by weight of the detergent composition of the present invention.

Useful surfactants include those products formed by condensing one or more alkylene oxides of from 2 to 4 carbon atoms, such as ethylene or propylene oxide, with a reactive hydrophobic compound such as a fatty acid, fatty alcohol, glycol, a sterol, a fatty amine or a fatty glyceride. Expecially preferred are the low-foaming fatty alcohol ethoxylates and ethylene oxide/propylene oxide block polymers. A surfactant comprises from about 0.5% to about 10% by weight of the composition herein.

This embodiment of the invention, as stated, may also optionally include inorganic fillers of which the alkali metal sulfates and carbonates are representative. We prefer to use from about 0% to 50% by weight sodium carbonate and from about 0% to 50% by weight sodium sulfate.

Oxygen bleaches which are suitable for use in this embodiment of the invention include compounds which provide available oxygen in a quantity of from about 0.05% by weight to 5% by weight available oxygen, preferably from about 0.1% to about 2% available oxygen by weight and most preferably, from about 0.25% to about 1% by weight available oxygen. By available oxygen, it is meant that the oxygen content is measured by that amount which is available to participate in oxidation reactions. Oxygen bleaches preferred for use in this embodiment of the invention are water soluble percompounds including alkali metal perborates, percarbonates, persulfates and perphosphates. Also suitable for use herein are the alkaline earth metal perphosphates, percarbonates and persulfates. Specific alkali metal perborates which are useful for the practice of the present invention include calcium perborate, potassium perborate, sodium perborate tetrahydrate, barium perborate, and sodium perborate monohydrate. Most preferred are the sodium perborates. Also suitable is hydrogen peroxide and its inorganic adducts. Virtually any organic peracid source of available oxygen will work in the present invention.

Proteolytic enzymes which can be used in this embodiment of the invention include those listed previously; that is, trypsin, chymotrypsin, pepsin, papain, bromelin, carboxylase, collagenase, keratinase, elastase, amino peptidase, subtilisin and aspergillopeptidase. Especially preferred are subtilisin enzymes derived from *bacillus subtillis*. Those proteolytic enzymes which are suitable for use in this embodiment of the invention are active in a pH range of from 4 to 12 at a temperature of from about 50 to 200. Esperase 4.0T, which has a minimum enzyme activity of 4 KNPU/g, which is a tradename for a proteolytic enzyme sold by Novo Industries, is particularly preferred for use herein. In this embodiment of the invention the machine dishwashing detergent composition contains a quantity of proteolytic enzyme which yields from about 2 KNPU to about 200 KNPU, preferably from about 4 KNPU to about 80 KNPU and most preferably from about 10 KNPU to about 40 KNPU per kilogram of the final composition.

In use, the polyacrylate-based water spot reduction composition of the present invention is added to a typical automatic dishwasher composition containing standard components such as alkalinity builders, surfactants, and silicates and approximately 60 grams of this mixture is placed in an automatic dishwasher along with the food soiled dishes. The dishwasher is then run through its wash and rinse cycles during which time the standard machine dishwasher composition and the water spot control composition are dispersed in the wash liquor. The wash liquor is then repeatedly circulated through the spray nozzles whereupon it is brought in contact with soiled dish surfaces. The water temperature may vary but is usually in the range of 100° F. to 140° F. Typically, automatic dishwashers have two separate receptacles for dishwashing compositions to be added sequentially during the wash cycles. For example, a model manufactured by the Hobart Corporation, Kitchen-Aid Energy Saver V Superba, operates with two consecutive wash cycles. The first wash cycle lasts for three minutes, forty seconds and the second wash cycle lasts for four minutes, forty-five seconds. Each dishwashing composition receptacle holds approximately 30 grams. The first receptacle dispenses its contents at the beginning of the first wash cycle and the second receptacle dispenses its contents at the beginning of the second wash cycle.

In use, the embodiment of the present invention which comprises a fully-built machine dishwasher detergent composition is placed in the dishwashing composition receptacles inside a machine dishwasher in the manner previously described to be dispensed at the beginning of the first wash cycle and then at the beginning of the second wash cycle. Soiled dishes are of course placed inside the dishwasher and the washing process specified above is commenced. For most machine dishwashers, 60 grams of the detergent composition will adequately clean and reduce spotting with a full load of soiled dishes.

All percentages stated herein are by weight unless otherwise indicated.

A further understanding of the present invention will be obtained from the following specific examples which are intended to illustrate the invention but not to limit the scope thereof, parts and percentages being by weight unless otherwise indicated.

In all of the following examples, the test procedure generally follows that set forth in CSMA, designation DCC-05, published April of 1974, and incorporated herein by reference. The dishwasher used was a Kitchen-Aid Energy Saver V Superba manufactured by the Hobart Corporation. For each of the examples, the heavy wash cycle was used. This dishwasher contains two detergent cups which open in two consecutive wash cycles. The first wash cycle lasts for three minutes, forty seconds and the second lasts for four minutes, forty-five seconds. The water temperature was held at 120° F. The water hardness used in the tests was 18 grains per gallon. In Examples I–III approximately 30 grams of dishwashing composition, including the water spot control composition, was added to each detergent cup. That is, a total of 60 grams of detergent composition including the water spot control composition was used to wash the test articles. In examples IV–VI, a total of 60 grams of the fully-built automatic dishwashing detergent composition of the present invention was used to wash the test articles.

In these examples, the specific proteolytic enzyme used was Esperase 4.0T, manufactured by Novo Industries of Denmark. Experase 4.0T has a specified minimum enzyme activity of 4.0 KNPU/g. In these test examples, sodium perborate monohydrate was used as the oxygen bleach.

For those examples containing sodium polyacrylate, the sodium polyacrylate used was an approximate 5000 molecular weight sodium polyacrylate.

EXAMPLE I

To a typical machine dishwashing detergent composition containing sodium tripolyphosphate, a non-ionic surfactant, sodium sulfate, and sodium silicate, there was added a quantity of sodium perborate monohydrate to achieve a final concentration in the mixture of 0.75% by weight available oxygen, a quantity of sodium polyacrylate to achieve a final concentration in the mixture of 2.5% by weight sodium polyacrylate, and a quantity of Esperase 4.0T to achieve a final concentration of 0.75% Esperase in the mixture. The glassware so washed and dried was then evaluated using the ratings set forth in the aforementioned CSMA standard; that is,

| Rating | Spotting |
|---|---|
| 1 | Glass Spotless |
| 2 | Spots at Random |
| 3 | One-Fourth of Glass Covered with Spots |
| 4 | One-Half of Glass Covered with Spots |
| 5 | Glass Completely Covered with Spots |

This comparison rating was employed for all of the examples. The glassware was examined, the rating for each piece of glassware tabulated and the results averaged. The average glassware spotting of glassware washed with this formation was 1.125.

EXAMPLE II

In accordance with the procedure set forth in the introduction to these examples, detergent formulation of sodium tripolyphosphate hexahydrate, non-ionic surfactant, sodium sulfate, and sodium silicate was combined with quantities of sodium perborate, sodium polyacrylate, and Esperase 4.0T such that the final concertration of available oxygen was 0.375%, by weight. The final concentration of sodium polyacrylate was 5.0% by weight and the final concentration of Experase was 1.125% by weight.

The glassware so washed and dried was observed and rated in accordance with the aforementioned spotting scale. The glassware was determined to have an average spotting rating of 1.0.

EXAMPLE III

In this example, the standard machine dishwashing detergent set forth in the previous example was combined with sodium perborate, sodium polyacrylate and esperase 4.0T to achieve final concentrations of 0.375% by weight available oxygen, 2.5% by weight sodium polyacrylate and a final concentration of Esperase 4.0T of 1.125% by weight.

After the glassware was washed and dried in accordance with the CSMA Test Standard, the glassware was inspected and found to have an average glassware spotting of 1.0.

EXAMPLE IV

In this example, the automatic dishwashing composition of the present invention was prepared as follows:

| Ingredient | % by Weight |
|---|---|
| Sodium Tripolyphosphate Hexahydrate | 76.76 |
| Sodium Metalsilicate Pentahydrate | 19.9 |
| Non-ionic Surfactant | 1.3 |
| Sodium Perborate Monohydrate | 1.79 |
| Esperase 4.0 T | .25 |

The composition was used to wash glassware in accordance with the aforementioned standard and the glassware so washed was found to have an average glassware spotting of 1.24.

EXAMPLE V

In this example, the automatic dishwashing composition of the present invention was prepared as follows:

| Ingredient | % by weight |
|---|---|
| Sodium Tripolyphosphate Hexahydrate | 74.55 |
| Sodium Metalsilicate Pentahydrate | 19.9 |
| Non-ionic Surfactant | 1.3 |
| Sodium Perborate Monohydrate | 3.75 |
| Esperase 4.0 T | .5 |

The composition was used to wash glassware in accordance with the aforementioned standard and the glassware so washed was found to have an average glassware spotting of 1.07.

What is claimed is:

1. An automatic dishwasher detergent composition consisting essentially of: from about 20 to about 80 percent by weight of a phosphate builder, based on anhydrous phosphate weight; from about 0.5 to about 10 percent by weight surfactant; from about 5 to about 40 percent by weight alkali metal silicate; a quantity of an oxygen bleach sufficient to provide from about 0.05 to about 5 percent by weight available oxygen; a quantity of proteolytic enzyme sufficient to provide from about 2 to about 200 KNPU per kilogram of said detergent composition; and from about 0.1 to about 20 percent by weight polyacrylate, said polyacrylate having a molecular weight in the range from about 500 to about 200,000.

2. The detergent composition of claim 1 consisting essentially of: from about 20 to about 40 percent by weight of said phosphate builder; a quantity of said oxygen bleach sufficient to provide from about 0.1 to about 2% by weight available oxygen; a sufficient amount of said enzyme to provide from about 4 to about 80 KNPU per kilogram of said detergent composition; and from about 1 to about 10 percent by weight of said polyacrylate.

3. The detergent composition of claim 2 consisting essentially of: a sufficient quantity of said oxygen bleach to provide from about 0.25 to about 1 percent by weight available oxygen; a sufficient amount of said enzyme to provide from about 10 to about 40 KNPU per kilogram of said detergent composition; and from about 2.5 to about 5 percent by weight of said polyacrylate.

4. The detergent composition of claim 3 in which said polyacrylate has a molecular weight of from about 1,000 to about 10,000.

5. The detergent composition of claim 4 wherein said phosphate compound is a polyphosphate.

6. The detergent composition of claim 1 in which said polyacrylate has a molecular weight of from about 1,000 to about 10,000.

7. The automatic dishwashing composition of claim 6 wherein said phosphate compound is a polyphosphate.

8. The detergent composition of claim 1 in which said polyacrylate has a molecular weight of from about 1,000 to about 10,000.

9. The automatic dishwashing composition of claim 8 wherein said phosphate compound is a polyphosphate.

10. The automatic dishwasher detergent composition recited in claim 1 wherein said oxygen bleach is a water-soluble inorganic percompound selected from the group consisting of alkali and alkaline earth metal perborates, percarbonates, perphosphates and persulfates.

11. The automatic dishwasher detergent composition recited in claim 1 wherein said proteolytic enzyme is selected from the group consisting of trypsin, chymotripsin, pepsin, papain, bromelin, carboxylase, collagenuse, kecatinase, elastase, amino peptidase, subtilisin and aspergillopeptidase.

12. The automatic dishwasher detergent composition recited in claim 10 wherein said polyacrylate has a molecular weight of from about 1,000 to about 10,000.

13. The automatic dishwasher detergent composition recited in claim 12 wherein said polyacrylate is selected from the group consisting of polymers and copolymers of acrylic acid, methacrylic acid, esters of these acids, and acrylonitrile.

14. The automatic dishwashing composition of claim 1 wherein said phosphate compound is a polyphosphate.

15. The automatic dishwashing composition of claim 1 wherein said surfactant is selected from the group consisting of low-foaming fatty alcohol ethoxylates and ethylene oxide/propylene oxide block polymers.

* * * * *

UNITED STATES PATENT AND TRADEMARK OFFICE

CERTIFICATE OF CORRECTION

PATENT NO. : 5,240,632

DATED : August 31, 1993

INVENTOR(S) : Ernest H. Brumbaugh

It is certified that error appears in the above-identified patent and that said Letters Patent is hereby corrected as shown below:

Column 3, Line 51:

"proteass" should be --protease--.

Column 4, Line 31:

After "composition" insert --comprises--.

Column 9, Line 22:

"Metalsilicate" should be --Metasilicate--.

Column 9, Line 38:

"Metalsilicate" should be --Metasilicate--.

UNITED STATES PATENT AND TRADEMARK OFFICE

CERTIFICATE OF CORRECTION

PATENT NO. : 5,240,632
DATED : August 31, 1993
INVENTOR(S) : Ernest H. Brumbaugh It is certified that error appears in the above-indentified patent and that said Letters Patent is hereby corrected as shown below:

Column 10, claim 6, line 24,

"claim 1" should be --claim 2--.

Signed and Sealed this

Third Day of May, 1994

Bruce Lehman

*Attest:*

BRUCE LEHMAN

*Attesting Officer*

*Commissioner of Patents and Trademarks*